US010392092B1

(12) United States Patent
Child

(10) Patent No.: US 10,392,092 B1
(45) Date of Patent: Aug. 27, 2019

(54) VERTICAL AXIS DRIVE SYSTEM

(71) Applicant: COX POWERTRAIN LIMITED, Shoreham-By-Sea (GB)

(72) Inventor: Matthew George Child, Shoreham-By-Sea (GB)

(73) Assignee: COX POWERTRAIN LIMITED, Shoreham-By-Sea (GB)

( * ) Notice: Subject to any disclaimer, the term of this patent is extended or adjusted under 35 U.S.C. 154(b) by 0 days.

(21) Appl. No.: 16/210,502

(22) Filed: Dec. 5, 2018

(30) Foreign Application Priority Data

May 16, 2018 (GB) ..... 1807931.9

(51) Int. Cl.
*B63H 20/14* (2006.01)
*B63H 20/00* (2006.01)
*F02B 61/04* (2006.01)

(52) U.S. Cl.
CPC ..... *B63H 20/14* (2013.01); *B63H 20/001* (2013.01); *F02B 61/045* (2013.01)

(58) Field of Classification Search
CPC ..... B63H 20/14; B63H 20/001; F02B 61/045
See application file for complete search history.

(56) References Cited

U.S. PATENT DOCUMENTS 4,702,202 A * 10/1987 Hensel ..... F02B 33/04 123/184.24
5,980,341 A 11/1999 Mishima et al.
6,159,063 A * 12/2000 Fujii ..... F02B 61/045 123/508
6,763,795 B2 * 7/2004 Takahashi ..... F02B 61/045 123/195 P
10,161,368 B1 * 12/2018 Koplitz ..... F02M 55/025
2004/0139939 A1 7/2004 Tsubouchi

FOREIGN PATENT DOCUMENTS

GB 2150220 6/1985
JP 2000110686 4/2000

OTHER PUBLICATIONS

Combined Search and Examination Report issued in App. No. GB1807931.9 (2018).

* cited by examiner

*Primary Examiner* — Stephen P Avila
(74) *Attorney, Agent, or Firm* — Barnes & Thornburg LLP

(57) ABSTRACT

The present invention relates to a drive system for outboard motors. The drive system comprises a combustion engine having a crankshaft adapted to rotate about a substantially vertical axis. The combustion engine further comprises a camshaft extending parallel to the vertical crankshaft. A high pressure fuel pump is provided for supplying high pressure fuels to the combustion cylinders. The high pressure fuel pump is directly driven by the camshaft.

26 Claims, 7 Drawing Sheets

VERTICAL AXIS DRIVE SYSTEM

CROSS REFERENCE TO RELATED APPLICATIONS

This application claims priority to United Kingdom application no. 1807931.9, filed May 16, 2018. The disclosure set forth in the referenced application is incorporated herein by reference in its entirety.

TECHNICAL FIELD

The present invention relates to a drive system, particularly but not exclusively, to a vertical axis drive system for an outboard motor of a marine vessel. Other aspects of the present invention relate to an outboard motor including the vertical crank axis drive system and a marine vessel being equipped with the outboard motor.

BACKGROUND

At present, the outboard engine market is dominated by petrol engines, which are mainly designed for smaller vessels, i.e. for the leisure market. Not only are petrol engines generally lighter than their diesel equivalents, conventional diesel engines for outboard motors often do not meet modern emissions standards. However, a range of users, from military operators to super-yacht owners begin to favour diesel outboard motors because of the improved safety of the heavier diesel fuel due to its lower volatility, and fuel compatibility with the mother ship. Furthermore, diesel is a more economical fuel source with a more readily accessible infrastructure.

In view of the above, diesel outboard motors have become the focus of marine research activity, with an aim to transforming the outboard engine market.

In order to fulfil current emissions standards, diesel internal combustion engines nowadays include more sophisticated charge systems. The new engines exhibit better performance, both in terms of power output and exhaust emission. In the past, charge performers utilised carburetors to fuel the combustion cylinders of the engine via manifold injection, whereas modern diesel engines use direct cylinder injection to improve performance characteristics. By injecting pressurised fuel directly into the combustion chambers, it is possible to achieve better air/fuel mixtures that result in better engine economy and emission control.

Particularly in vertical drive systems, e.g. for outboard motors, the utilisation of direct cylinder injection requires the use of high pressure pumps. Normally, positive displacement pumps are employed for this purpose. Some known drive systems include high pressure positive displacement pumps that are directly driven off the crankshaft of the engine.

Driving the fuel pump off the crankshaft comes with a number of issues. Firstly, due to the limited packaging space, it is generally undesirable to attach a high pressure fuel pump directly to the end of the crankshaft, resulting in bulkier arrangements. As a consequence, complicated transmission arrangements are often employed to place the high pressure pump within the existing space envelope.

In view of the above shortcomings of the prior art, it is an object of the present invention to overcome the problems associated with conventional solutions and provide a new drive system for outboard motors optimising the use of existing packaging space and exhibiting increased pump effectiveness.

According to a first aspect of the present invention, there is provided a drive system for a marine outboard motor, the drive system comprising an internal combustion engine connected to a proportion device, the internal combustion engine comprising a crankshaft for driving the proportion device, wherein, in use, the crankshaft is arranged to rotate about a substantially vertical crankshaft axis, and wherein the internal combustion engine further comprises a camshaft for operating one or more cylinder valves of the engine, said camshaft being arranged for rotation about a camshaft axis arranged substantially parallel to the crankshaft axis. The drive system further comprises a fuel pump for pressurising fuel used to operate the internal combustion engine, said fuel pump being configured to be driven by the camshaft.

Since drive systems for outboard motors usually include a vertical crankshaft, problems can occur with the orientation of the fuel pump if oriented in a standard orientation, with its axis of rotation parallel with a vertical crank shaft. In particular, the fuel pump is sensitive to the orientation in which it is operated, that is, high pressure fuel pumps are not designed to carry significant thrust loads along the pump rotational axis, such as when the pump axis is arranged vertically, i.e. in line with the crankshaft. The drive system of the invention seeks to address these drawbacks and others, as will be apparent from a full reading of the following specification.

In the specification, the fuel pump being "driven by the camshaft" means that the fuel pump is connected to the camshaft such that the hydraulic output of the fuel pump is directly dependent on the rotary speed of the camshaft. This particular arrangement has the advantage that existing packaging space can be used most effectively. Using the camshaft to drive the pump also eases maintenance of the drive system, since the pump can be arranged to be more readily accessible on the outside of the internal combustion engine. Where conventionally a fuel pump may have been driven directly from the crankshaft of an engine, in the present invention, although the drive ultimately is derived from the crank shaft, (as is all rotary power generated in an internal combustion engine of the type described herein), in the invention, the camshaft lies in the drive train between the crankshaft and the fuel pump.

In the present specification, the term "vertical" when applied to the combustion engines or shafts described herein, is intended to reflect the orientation of the relevant shafts during normal use of the engine. A skilled reader will therefore appreciate that, for example, a vertical crankshaft or cam shaft axis is one which is oriented in a substantially vertical direction during use of the engine. In a marine outboard motor this will be understood to mean that the relevant axis is substantially parallel to an axis passing from the power head to the lower section of the outboard motor, or otherwise substantially in line with the leg of the motor. Vertical is understood in the normal way, i.e. defined by the direction of gravity during normal use of the engine.

In another embodiment, the fuel pump comprises an input shaft arranged to rotate about an input shaft axis, said input shaft axis being arranged at an angle between 30 to 150 degrees with respect to said camshaft axis. The angle between the input shaft axis and the camshaft axis may preferably be in the range of 80 to 100 degrees. In one embodiment, the input shaft axis may be arranged substantially perpendicular to the camshaft axis. In a drive system of the present invention, the crankshaft and the camshaft are arranged in a vertical direction. Arranging the input shaft axis of the pump perpendicular to the camshaft axis, therefore, allows for the pump to be arranged in a substantially horizontal direction. This will cause the high pressure fuel pump to work more effectively, as the pump is not required to carry significant thrust loads along the pump rotational axis.

In another embodiment, the camshaft is a substantially hollow shaft. This will reduce the weight of the drive system and provides access points for a transmission assembly described in more detail below.

The fuel pump may be a high pressure fuel pump. As such, the fuel pump may be used to supply pressurised fuel at a pressure of 1000 to 3000 bar for injection into the combustion cylinders. The fuel pump may be a gear pump. Implementing a gear pump as the fuel pump has the advantage that rotational energy from the camshaft can be directly applied to a rotary input shaft of the pump.

According to yet another embodiment, the drive system comprises a transmission assembly configured to connect the camshaft to the input shaft of the fuel pump. If the input shaft axis of the fuel pump is arranged at an angle with respect to the camshaft axis, as described hereinbefore, the transmission assembly may be used to establish said angular connection and transfer power between the camshaft and the input shaft. The transmission assembly may be an integral part of the fuel pump. Alternatively, the transmission assembly may be a separate part that is removably connected between the camshaft and the fuel pump. The transmission assembly may comprise gears to convert the rotational energy of the camshaft into the required input speed and torque for the input shaft of the fuel pump.

The camshaft may be connected to the transmission assembly such that the camshaft is movable along the camshaft axis with respect to the transmission assembly. In the vertical arrangement of the present drive system, the camshaft of this embodiment is movable upwards and downwards along its vertical camshaft axis whilst maintaining its connection to the fuel pump via the transmission assembly. The arrangement enables torque to be transferred from the camshaft to the fuel pump whilst permitting movement of the shaft along it rotational axis. In other words, the camshaft is floatingly connected to the transmission assembly. In one embodiment, the camshaft may, therefore, comprise a plurality of splines at a first end. The first end is connected to the fuel pump and, preferably, arranged at a bottom end of the camshaft. The splines may be arranged on an inner or outer surface of the camshaft and adapted to connect with a corresponding, splined part of the transmission assembly.

The transmission assembly may comprise a casing, releasably connected to a housing of the fuel pump. As such, the transmission assembly is easily removable from the fuel pump for maintenance purposes. The casing may also form an internal cavity configured to receive the lubricant. The casing may comprise an inlet port connected to an oil pump of the internal combustion engine. Consequently, the transmission assembly may be provided with lubricant by means of the existing lubrication system and does not require additional oil reservoirs to be provided.

In another embodiment, the transmission assembly comprises first and second bevel gears. The first and second bevel gears are arranged inside the internal cavity of the casing, which simultaneously acts as a lubrication chamber for the latter. The bevel gears are adapted to connect the camshaft and the input shaft of the fuel pump at the desired angle, e.g. 90 degrees. The first and second bevel gears may include straight or helical teeth, which are in meshing engagement to transfer the rotational energy of the camshaft to the input shaft of the fuel pump.

The first and second bevel gears may have an integer gear ratio. Alternatively, the first and second bevel gears may have a non-integer gear ratio.

In another embodiment, the transmission assembly may comprise a constant-velocity joint. In yet another embodiment, the transmission assembly may comprise a universal joint.

The internal combustion engine may comprise first and second cylinder bank arranged in a V-shaped engine block having a valley defined between a first plane extending through the first cylinder bank and a second plane extending through the second cylinder bank, wherein the fuel pump is arranged within said valley. Arranging the fuel pump within the valley, between at least the planes of the first and second cylinder banks, and optionally between the cylinder banks themselves, optimises the use of the available packaging space within the cowling of an outboard motor.

The valley of the V-shaped engine block may comprise a first end arranged closer to the propulsion device than an opposite, second end, wherein the fuel pump may be arranged at or toward the first end of the valley. In other words, the fuel pump may be arranged at or toward a bottom end of the valley. This arrangement supports the connection between the camshaft and the input shaft of the fuel pump via the transmission assembly, as the camshaft may simply protrude from its corresponding valve block at the bottom end thereof.

According to yet another embodiment, the drive system comprises a cowling surrounding the internal combustion engine and the fuel pump. A fuel rail may be received within the cowling and may be hydraulically connected to an outlet port of the fuel pump. Similar to the fuel pump, the injector rail may be arranged within the valley of the V-shaped engine block, or at least between the planes of the first and second cylinder banks.

In another embodiment, the propulsion device may comprise a propeller arranged to rotate about a propeller axis, wherein the propeller axis is substantially perpendicular to the crankshaft axis.

In another aspect of the present invention, there is provided an outboard motor for a marine vessel comprising the drive system described hereinbefore.

In yet another aspect of the present invention, there is provided a marine vessel comprising the outboard motor.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to amend any originally filed claim to depend from and/or incorporate any feature of any other claim even if not originally claimed in that manner.

BRIEF DESCRIPTION OF THE DRAWINGS

In the following detailed description, the invention will be described in more detail, by way of example only, with reference to the attached drawings, in which.

DETAILED DESCRIPTION

Figure 1:
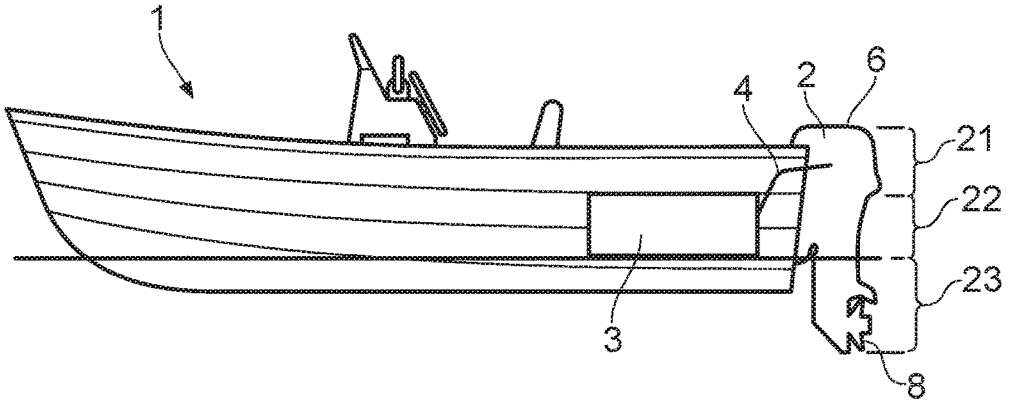
FIG. 1 is a schematic side view of a light marine vessel provided with an outboard motor.

Turning to FIG. 1, there is shown a schematic side view of a marine vessel 1 with an outboard motor 2. The marine vessel 1 may be any kind of vessel suitable for use with an outboard motor, such as a tender or a scuba-diving boat. Whilst this detailed description refers to an inventive drive system embodied in an outboard motor for marine use, it will be understood that the drive system of the present invention may alternatively be utilised in various other engine applications, specifically those in which the engine is operated vertically, that is, if the crankshaft is oriented along a vertically extending axis. Such alternative embodiments include helicopter drive systems, inboard marine engines, electrical generation modules, dirigibles, etc.

Turning back to the outboard motor 2 shown in FIG. 1, the latter is attached to the stern of the vessel 1. The outboard motor 2 is connected to a fuel tank 3, usually received within the hull of the marine vessel 1. Fuel from the reservoir or tank 3 is provided to the outboard motor 2 via a fuel line 4. Fuel line 4 may be a representation for a collective arrangement of one or more filters, low pressure pumps and evaporator tanks arranged between the fuel tank 3 and the outboard motor 2.

As will be described in more detail with reference to FIG. 3 below, the outboard motor 2 is generally divided into three sections, an upper-section 21, a mid-section 22, and a lower-section 23. The three sections 21, 22 and 23 are collectively surrounded by a protective cowling 6. A propeller 8 is rotatably arranged at the lower-section, also known as the gear box of the outboard motor. Of course, in operation, the propeller 8 is at least partly submerged in the water and may be operated at varying rotational speeds to propel the marine vessel 1.

Typically, the outboard motor 2 is pivotally connected to the stern of the marine vessel 1 by means of a pivot pin. Pivotal movement about the pivot pin enables the operator to tilt and trim the outboard motor about a horizontal axis in a manner known in the art.

Figure 2A:
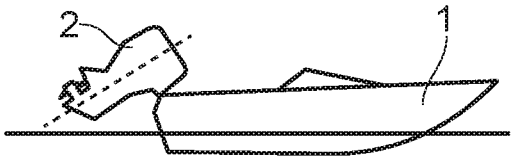
FIG. 2*a* shows a schematic representation of an outboard motor in its tilted position.

Tilting is a movement that raises the lower-section of the outboard motor 2 far enough to raise the propeller to the surface or completely out of the water. Tilting the outboard motor is usually performed with the motor turned off or in neutral. As mentioned previously, to work properly, the lower-section and propeller of the outboard motor 2 needs to extend into the water. In extremely shallow waters, however, or when launching a boat off a trailer, the lower-section of an outboard motor could drag on the seabed or boat ramp if in the tilted-down position. Tilting the motor into its tilted-up position, such as the position shown in FIG. 2*a*, prevents such damage to the lower-section and the propeller.

Figure 2B:
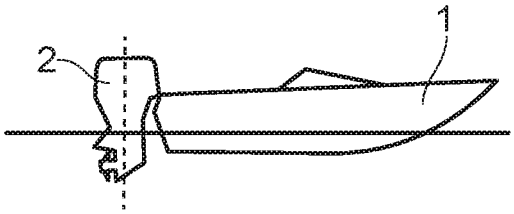
FIGS. 2*b* to 2*d* show various trimming positions of the outboard motor and the corresponding orientation of the marine vessel within a body of water.
Figure 2C:
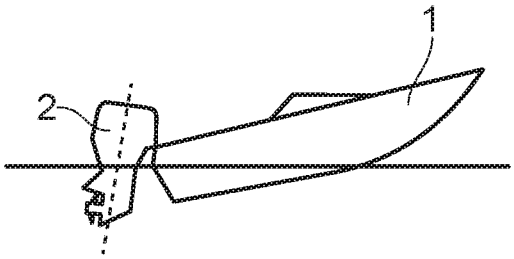
Figure 2D:
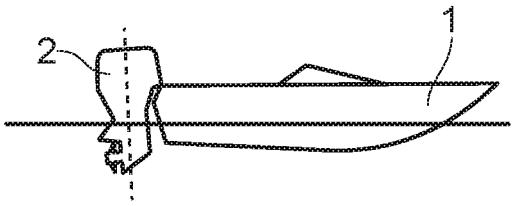

By contrast, trimming is the mechanism that moves the motor over a smaller range from a fully-down position to a few degrees upwards, as shown in the three examples of FIGS. 2*b* to 2*d*. Trimming will help to direct the thrust of the propeller in a direction that will provide the best combination of acceleration and high speed operation of the corresponding marine vehicle.

When the boat is on a plane (i.e. the weight of the vessel is predominantly supported by hydrodynamic lift, rather than hydrostatic lift, a bow-up configuration results in less drag, greater stability and efficiency. This is generally the case when the keel line of the boat or marine vessel 1 is up about three to five degrees, such as shown in FIG. 2*b* for example.

Too much trim-out puts the bow of the boat too high in the water, such as the position shown in FIG. 2*c*. Performance and economy, in this configuration, are decreased because the hull of the boat is pushing the water and the result is more air drag. Excessive trimming-up can also cause the propeller to ventilate, resulting in further reduced performance. In even more severe cases, the boat may hop in the water, which could throw the operator and passengers overboard.

Trimming-in will cause the bow of the boat to be down, which will help accelerate from a standing start. Too much trim-in, shown in FIG. 2*d*, causes the boat to "plough" through the water, decreasing fuel economy and making it hard to increase speed. At high speeds, trimming-in may even result in instability of the vessel.

Figure 3:
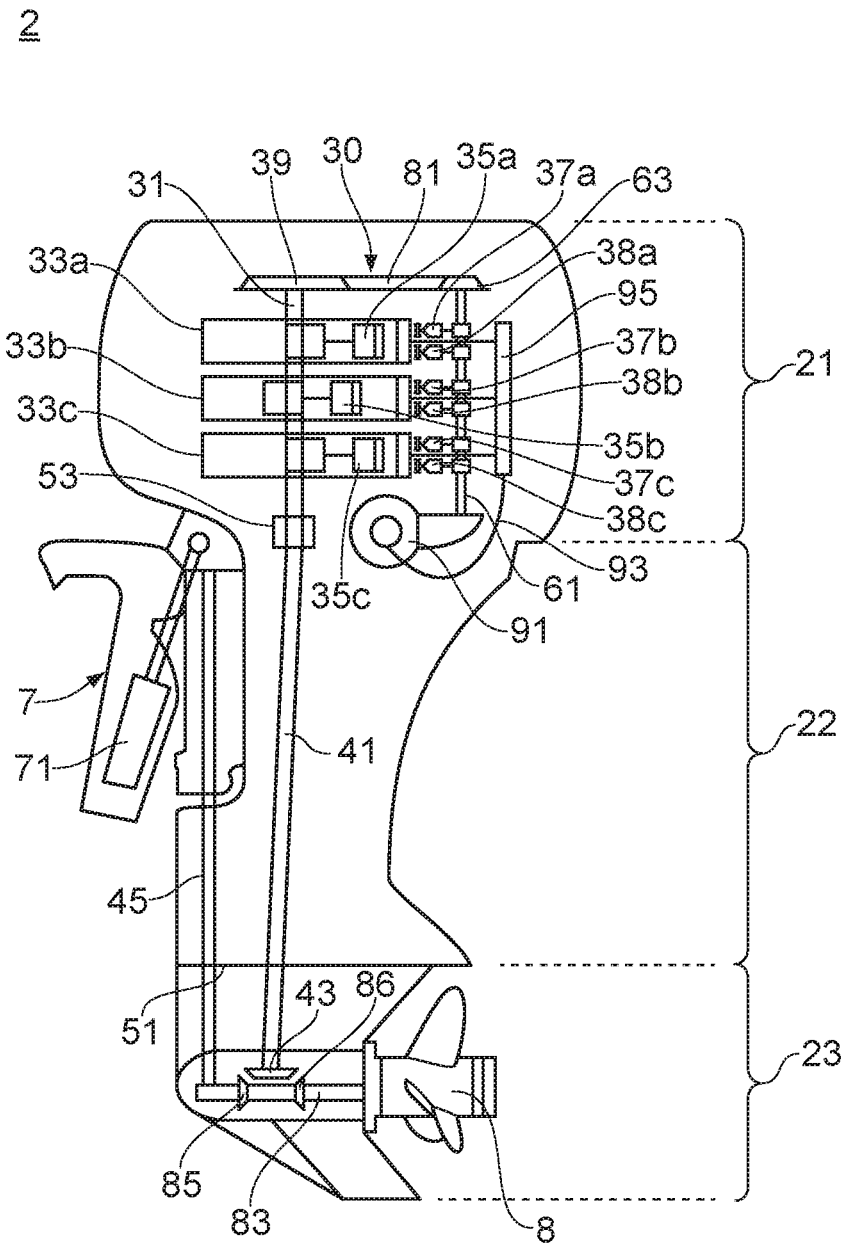
FIG. 3 shows a schematic cross-section of an outboard motor including a drive system according to an embodiment of the present invention.

Turning to FIG. 3, there is shown a schematic cross-section of an outboard motor 2 including a drive system according to an embodiment of the present invention. The outboard motor 2 comprises a tilt and trim mechanism 7 for performing the aforementioned tilting and trimming operations. In this embodiment, the tilt and trim mechanism 7 includes a hydraulic actuator 71 that can be operated to tilt and trim the outboard motor 2 via an electric control system. Alternatively, it is also feasible to provide a manual tilt and trim mechanism, in which the operator pivots the outboard motor by hand rather than using a hydraulic actuator shown in FIG. 3.

As mentioned hereinbefore, the outboard motor 2 is generally divided into three sections. An upper-section 21, also known as the power head, includes a combustion engine 30, which will be described in more detail below. Adjacent to and extending below the upper-section 21 of the power head, there is provided a mid-section 22, also known as the exhaust housing. The mid-section 22 or exhaust housing connects the upper-section 21 to the lower-section 23 and houses a drive shaft 41 connected to the crankshaft 31 of the combustion engine 30. At the same time, the mid-section 22 commonly defines an exhaust path transporting exhaust gasses from the outlet of the combustion chambers towards the lower-section 23. The lower-section 23 extends adjacent to and below the mid-section 22. An anti-ventilation plate 51, which prevents surface air from being sucked into the negative pressure side of the propeller 8, separates the mid-section 22 from the lower-section 23.

Figure 5:
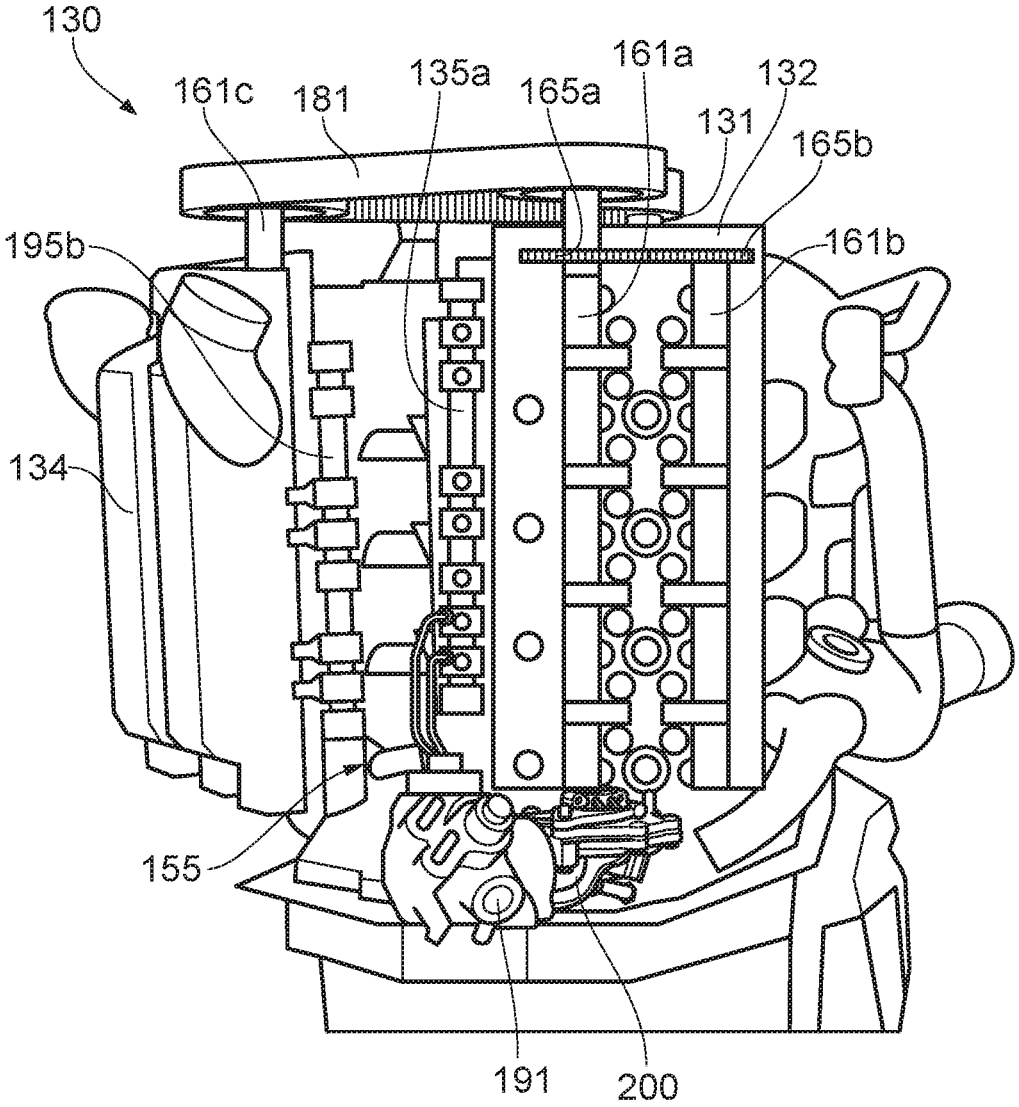
FIG. 5 shows a part-sectional perspective view of an embodiment of the drive system according to the present invention.

Referring back to the combustion engine 30 provided in the power head or upper-section 21 of the outboard motor 2, there is shown a schematic representation of one side of a four-stroke V6 diesel engine. It will be understood that any other amount of cylinders may be employed in the V-shaped cylinder banks, such as the V8 embodiment shown in FIG. 5. The skilled person will also understand that any other arrangement, such as an in-line arrangement could alternatively be utilised. Finally, while FIGS. 3 and 5 illustrate four-stroke-type engines, the drive system of the present invention could equivalently be constructed as a two-stroke-type combustion engine.

The combustion engine 30 shown schematically in FIG. 3 includes a variety of combustion chambers/cylinders 33*a*, 33*b*, 33*c*. Each of the combustion cylinders 33*a*, 33*b*, 33*c* is provided with a moveable piston 35*a*, 35*b*, 35*c*. Each of the pistons 35*a* to 35*c* is connected at its back end to a crankshaft 31 as is well known in the art. The pistons 35*a* to 35*c* separate the crankshaft 31 from the combustion section of the cylinders 33*a* to 33*c*, that is, from inlet and outlet ports controlled by corresponding inlet valves 37*a*, 37*b*, 37*c* and outlet valves 38*a*, 38*b* and 38*c*.

The crankshaft 31 is connected at its lower end to a drive shaft 41 via a floating connector 53 (e.g. a splined connection), which will allow the drive shaft and the crankshaft 31 to move with respect to each other along the vertical axis of the crankshaft 31. At the lower end of the drive shaft 41, a gear box/transmission is provided that supplies the rotational energy of the drive shaft 41 to the propeller 8 in a horizontal direction. In more detail, the bottom end of the drive shaft 41 may include a bevel gear connected to a pair of bevel gears that are rotationally connected to a horizontal input shaft 83 of the propeller 8.

FIG. 3 also schematically shows a disconnect mechanism 45, which may be used to disconnect the drive shaft 41 from the input shaft 83 as fail-safe measure in case of combustion engine failure.

At its upper end, the crankshaft 31 is provided with a fly wheel 39. Although not shown in detail in FIG. 3, the fly wheel includes a pulley connected to the crankshaft. The crankshaft pulley is connected to a drive pulley 63 of a camshaft 61 via a timing belt 81.

The camshaft 61 extends parallel to the crankshaft 31, i.e. along a substantially vertical axis in FIG. 3. As is generally known, the camshaft 61 includes a variety of cams for actuating the inlet and outlet valves 37*a*, 37*b*, 37*c*, 38*a*, 38*b*, 38*c*, in an accurately timed fashion. The rotational speed ratio between the crankshaft and the camshaft is conventionally set by means of the pulleys and their corresponding timing belt.

At a lower end of the camshaft 61, i.e. at an opposite end to the drive pulley 63, there is provided a high pressure fuel pump 91. In one example, the high pressure fuel pump may be a positive displacement pump. Preferably, the high pressure fuel pump 91 may be a rotary gear pump. The rotary power input is directly provided by the camshaft 61.

The high pressure fuel pump 91 comprises an inlet port (not shown) which is connected to the aforementioned low pressure fuel pump (not shown) included in the fuel supply line 4 that connects the fuel tank 3 with the outboard motor 2. Fuel supplied to the high pressure pump 91 is ejected via an outlet port of the latter with high flow along fluid conduit 93, towards fuel rail 95. The high flow fuel in fuel conduit 93 results in high pressure present in fuel rail 95 that will be injected into the combustion chambers 33*a* to 33*c* in a synchronised manner by corresponding injectors connected to the fuel rail 95. The pressure present in the fuel rail 95 may be as high as 2000 bar, for example.

As has been described hereinbefore, driving the high pressure fuel pump 91 directly off the camshaft 61, optimises the use of the limited packaging space available within the drive system, particularly within the power head of the outboard motor of this present embodiment.

Figure 4:
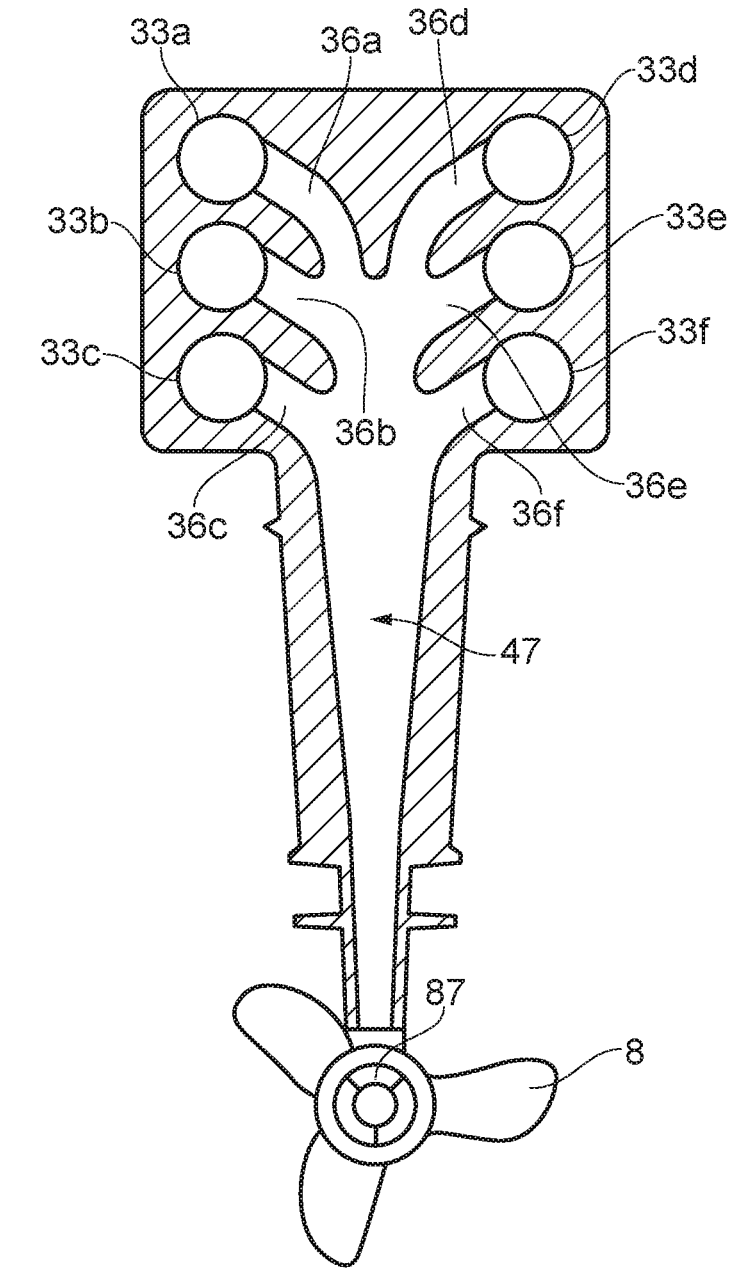
FIG. 4 shows another cross-section of the outboard motor shown in FIG. 3 along the exhaust path.

Turning to FIG. 4, there is shown a schematic cross-section of the outboard motor 2 in a lateral direction. The cross-section schematically shows outlet ports 36*a*, 36*b*, 36*c*, 36*d*, 36*e*, 36*f* of the six combustion cylinders 33*a*, 33*b*, 33*c*, 33*d*, 33*e*, 33*f*. The outlet ports 36*a* to 36*f* feed into a common exhaust path 47 extending through the mid-section 22 and the lower-section 23 of the outboard motor 2. Exhaust gasses ejected from the combustion cylinders 33*a* to 33*f* are thus vented through exhaust openings 87 of the propeller 8. The exhaust openings 87 are connected to the exhaust path 47.

Although not shown in FIG. 4, the lower end of the mid-section 22 or the lower-section 23 may include cooling inlets through which sea water may enter the housing structure of the outboard motor for cooling the combustion engine 30.

Turning to FIG. 5, there is shown another embodiment of the drive system according to the present invention. In the embodiment of FIG. 5, the combustion engine 130 is represented by a V8 engine. In particular, the V8 combustion engine 130 of FIG. 5 includes a first cylinder bank 132 and a second cylinder bank 134. The first and second cylinder banks 132, 134 are arranged in a V-configuration. As such, a valley 155 is formed between the first and second cylinder banks 132, 134. In more detail, the first cylinder bank 132 defines a first plane that intersects the combustion cylinders of the first cylinder bank 132. The second bank 134 defines a plane that intersects the combustion cylinders of the second cylinder bank 134. The valley 155 is located between the two planes defined by the first and second cylinder banks 132, 134. A high pressure fuel pump 191 is arranged within the valley 155 between the two cylinder banks 132, 134. Particularly, the high pressure fuel pump 191 is connected at or toward to a lower end of the valley 155, which facilitates the mechanical connection between the fuel pump 191 and the camshaft 161.

The high pressure fuel pump 191 is connected to corresponding fuel rails 195*a*, 195*b*. Both fuel rails 195*a* and 195*b* are arranged within the valley 155 between the first and second cylinder banks. A first fuel rail 195*a* is adapted to provide pressurised fuel to the combustion cylinders of the first cylinder bank 132. A second fuel rail 195*b* is adapted to provide pressurised fuel to the cylinders of the second cylinder bank 134.

Although only shown in the sectioned first cylinder bank 132, each of the cylinder banks 132, 134 can include two parallel camshafts that extend parallel to each other along respective vertical axes. The first camshaft 161*a* of the first cylinder bank 132 is connected to the crankshaft 131 of combustion engine 130 via corresponding drive pulleys and timing belt 181. In the illustrated optional arrangement, the second camshaft 161*b* is connected at its upper end to the first camshaft 161*a* via intermeshing gear wheels 165*a*, 165*b*, though conventional pulley wheels located on each cam shaft and each engaging the timing belt 181 can be used. The illustrated second camshaft 161*b* will thus rotate at the same speed as the first camshaft 161*a*, in an opposite direction. The intermeshing gear wheels 165*a*, 165*b* are arranged at the top end of their corresponding camshafts. The first and or the second camshaft 161*a*, 161*b* may be a hollow shaft to reduce weight of the drive system.

At an opposite, bottom end of the first camshaft 161*a* of the first cylinder bank 132, the high pressure pump 191 is connected with the first camshaft 161*a*. In detail, the drive system of this embodiment includes a transmission assembly 200 connecting the lower end of the first camshaft 161*a* with an input shaft of the high pressure pump 191.

It will be understood that the configuration of the second cylinder bank 134 is substantially identical to the configuration of the first cylinder bank 132. In particular, a first camshaft 161*c* of the second cylinder bank 134 is also driven by the timing belt 181 and a corresponding drive pulley connected to the top end of the first camshaft 161*c*. Yet, it is preferred to provide a single high pressure pump 191 providing both the first and second cylinder bank 132, 134 with high pressure fuel. As such, rotational movement of the first camshaft 161*c* of the second cylinder bank 134 is preferably not required to drive the high pressure pump 191.

Figure 6B:
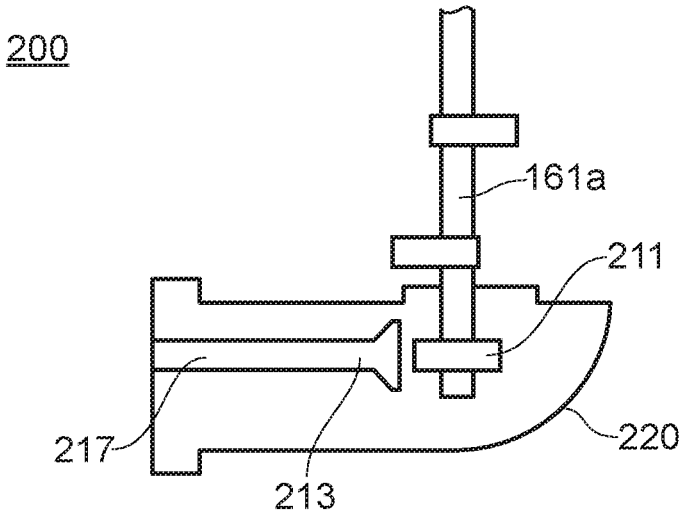
FIG. 6*b* shows a schematic cross-section of a transmission assembly according to another variant.
Figure 6A:
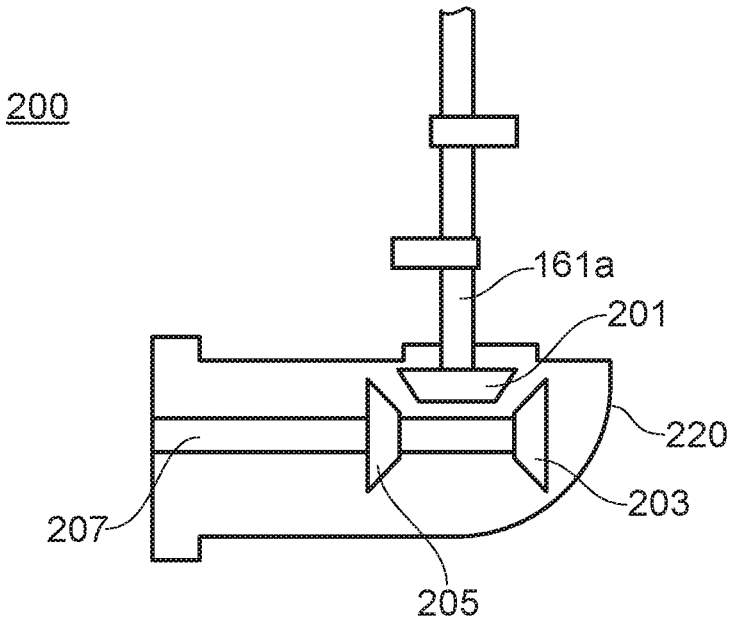
FIG. 6*a* shows a schematic cross-section of a transmission assembly according to one variant.

Two exemplary embodiments of the transmission assembly 200 shown in FIG. 5 are schematically illustrated in FIGS. 6*a* and 6*b*.

In the embodiment of FIG. 6*a*, a bevel gear 201 is arranged on an end of first camshaft 161*a*. Bevel gear 201 meshes with one or more, optionally a pair, of corresponding bevel gears 203, 205 located on an input shaft 207 of the high pressure pump 191. As such, rotation of the camshaft 161*a* about a substantially vertical axis can be transferred into rotation of the input shaft 207 in a substantially horizontal direction. This will enable operation of the high pressure pumps in a horizontal orientation.

In the embodiment of FIG. 6*b*, an additional cam 211 is provided at the bottom end of camshaft 161*a*. A follower schematically referred to with reference numeral 213 is continuously pressed against the outer surface of the cam 211 and acts as a cam follower, similar to conventional cylinder valves. The follower 213 drives input shaft 217 of the high pressure pump in a reciprocating manner. The input shaft may be configured to drive a conventionally known piston pump.

The lower end of the first camshaft 161*a* in both embodiments of FIGS. 6*a* and 6*b* may be connected floatingly with the input bevel gear 201/the input cam 211 of the transmission assembly 200. In particular, a floating connector may be provided, enabling movement of the first camshaft 161*a* with respect to the transmission assembly 200 along the vertical axis of the first camshaft 161*a*, whilst allowing a torque to be transferred. The floating connector may be formed as a splined connection between the lower end of the camshaft 161*a* and the corresponding upper end of the input bevel gear 201 or the input cam 211 respectively.

Figure 7A:
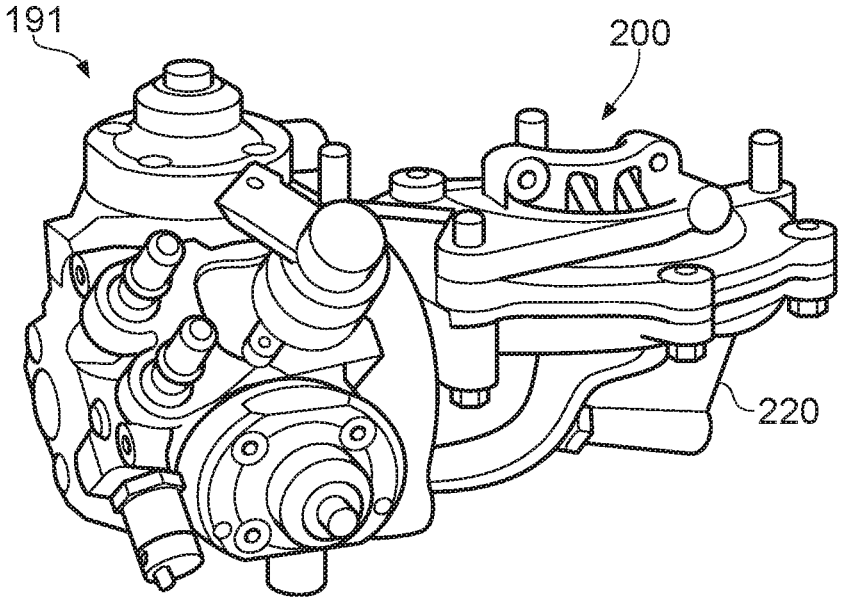
FIG. 7*a* shows a perspective view of a high pressure pump and transmission assembly in the connected state.
Figure 7B:
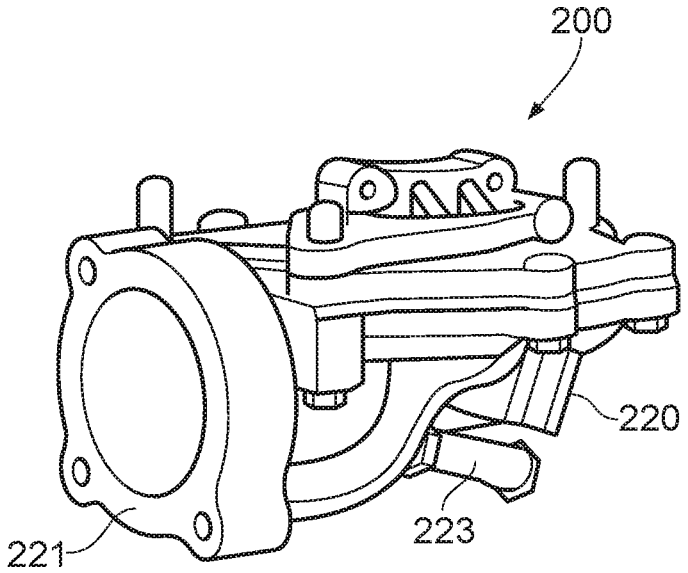
FIG. 7*b* shows a perspective view of the transmission assembly of FIG. 7*a*.

It will be appreciated that all of the parts of the transmission assembly shown in FIGS. 6*a* and 6*b* are received inside a transmission assembly casing 220, which is described in more detail with reference to FIGS. 7*a* and 7*b*. FIG. 7*a* shows the transmission assembly 200 connected to the high pressure fuel pump 191. Preferably, the casing 220 of the transmission assembly is removably connectable to the housing structure of the high pressure fuel pump 191. To this end, the casing 220 of the transmission assembly 200 includes a flange section 221 that may be attached to a corresponding flange section of the high pressure pump 191 and mounted to the latter by means of a plurality of fastening bolts (not shown). The casing 220 of the transmission assembly 200 is constructed as a receptacle for lubricant, e.g. as an oil sump for lubricating mechanical parts housed therein. Preferably, lubricant from the combustion engine's oil pump may be provided to the inside of the casing 220 via a lubricant supply duct 223. The lubricant supply duct 223 may be directly connected to the oil gallery of the combustion engine 130. Lubricant supplied to the inside of the casing 220 may, for example, be distributed within the casing by means of the pair of bevel gears 203, 205.

The invention claimed is:

1. A drive system for a marine outboard motor, the drive system comprising an internal combustion engine connected to a propulsion device, the internal combustion engine comprising a crankshaft for driving the propulsion device, wherein, in use, the crankshaft is arranged to rotate about a substantially vertical crankshaft axis, and wherein the internal combustion engine further comprises a camshaft for operating one or more cylinder valves of the engine, said camshaft being arranged for rotation about a camshaft axis arranged substantially parallel to the crankshaft axis, the drive system further comprising a fuel pump for pressurizing fuel used to operate the internal combustion engine, said fuel pump being configured to be driven by the camshaft, wherein the fuel pump comprises an input shaft arranged to rotate about an input shaft axis, said input shaft axis being arranged at an angle between 30 to 150 degrees with respect to said camshaft axis.

2. The drive system of claim 1, wherein said input shaft axis is arranged at an angle between 80 and 100 degrees with respect to said camshaft axis.

3. The drive system of claim 2, wherein the input shaft axis is arranged substantially perpendicular to the camshaft axis.

4. The drive system of claim 2, wherein, in use, the input shaft axis is arranged in a substantially horizontal direction.

5. The drive system of claim 1, wherein the camshaft is a substantially hollow shaft.

6. The drive system of claim 1, wherein the fuel pump is a high pressure fuel pump.

7. The drive system of claim 1, wherein the fuel pump is a gear pump.

8. The drive system of claim 1, comprising a transmission assembly configured to connect the camshaft to an input shaft of the fuel pump.

9. The drive system of claim 8, wherein the camshaft is connected to the transmission assembly such that the camshaft is movable along the camshaft axis with respect to the transmission assembly.

10. The drive system of claim 9, wherein the camshaft comprises a plurality of splines at a first end.

11. The drive system of claim 8, wherein the transmission assembly comprises a casing, releasably connected to a housing of the fuel pump.

12. The drive system of claim 11, wherein the casing forms an internal cavity configured to receive lubricant.

13. The drive system of claim 12, wherein the casing comprises an inlet port connected to an oil pump of the internal combustion engine.

14. The drive system of claim 8, wherein the transmission assembly comprises first and second bevel gears.

15. The drive system of claim 14, wherein the first and second bevel gears include straight or helical teeth.

16. The drive system of claim 14, wherein the first and second bevel gears have an integer gear ratio.

17. The drive system of claim 14, wherein the first and second bevel gears have a non-integer gear ratio.

18. The drive system of claim 8, wherein the transmission assembly comprises a constant-velocity joint.

19. The drive system of claim 8, wherein the transmission assembly comprises a universal joint.

20. The drive system of claim 1, wherein the internal combustion engine comprises first and second cylinder banks arranged in a V-shaped engine block having a valley defined between a first plane extending through the first cylinder bank and a second plane extending through the second cylinder bank, and wherein the fuel pump is arranged within said valley.

21. The drive system of claim 20, wherein the valley of the V-shaped engine block comprises a first end arranged closer to the propulsion device than an opposite, second end, and wherein the fuel pump is arranged at the first end of the valley.

22. The drive system of claim 1, comprising a cowling surrounding the internal combustion engine and the fuel pump.

23. The drive system of claim 22, comprising a fuel rail received within the cowling and hydraulically connected to an outlet of the fuel pump.

24. The drive system of claim 1, wherein the propulsion device comprises a propeller arranged to rotate about a propeller axis, and wherein the propeller axis is substantially perpendicular to the crankshaft axis.

25. An outboard motor for a marine vessel comprising the drive system of claim 1.

26. A marine vessel comprising the outboard motor of claim 25.

* * * * *